US005642910A

United States Patent [19]

Betherum

[11] Patent Number: 5,642,910

[45] Date of Patent: Jul. 1, 1997

[54] MULTI-POSITION DOOR HINGE LOCK

[76] Inventor: Gary J. Betherum, 36332 Via Alamo, San Juan Capistrano, Calif. 92675

[21] Appl. No.: 697,133

[22] Filed: Aug. 20, 1996

[51] Int. Cl.[6] ..... E05C 19/18

[52] U.S. Cl. ..... 292/288; 292/DIG. 17; 16/82; 16/319; 16/353

[58] Field of Search ..... 292/288, DIG. 17; 16/82, 223, 374, 319, 353

[56] References Cited

U.S. PATENT DOCUMENTS

| | | | |
|---|---|---|---|
| 314,105 | 3/1885 | Carnes | 16/82 |
| 485,613 | 11/1892 | Deane | 16/82 X |
| 3,918,121 | 11/1975 | Williams | 16/82 X |
| 5,560,080 | 10/1996 | Reed | 16/82 |

FOREIGN PATENT DOCUMENTS

| | | | |
|---|---|---|---|
| 469538 | 5/1954 | Italy | 16/353 |
| 307609 | 3/1929 | United Kingdom | 292/288 |

*Primary Examiner*—Rodney M. Lindsey
*Attorney, Agent, or Firm*—Morland C. Fischer

[57] ABSTRACT

A non-destructible, multi-position hinge lock to be coupled to the existing hinge assembly of a door so as to be capable of reliably retaining the door in either an opened or closed position relative to a doorway. The hinge lock has a hollow interior in which to receive the hinge pin of the existing hinge assembly of the door. A first longitudinal channel is formed in the hinge lock in which to receive the pair of hinge plates of the existing hinge assembly when the door is rotated to a closed position and the hinge plates are correspondingly rotated into face-to-face alignment with one another. The hinge lock includes second and third longitudinal channels formed therein in which to receive respective ones of the hinge plates when the door is rotated to a first opened position and the hinge plates are correspondingly rotated to form an angle of 90 degrees. The hinge lock also includes fourth and fifth longitudinal channels formed therein in which to receive respective ones of the hinge plates when the door is rotated to a second opened position and the hinge plates are correspondingly rotated to form an angle of 180 degrees.

14 Claims, 4 Drawing Sheets

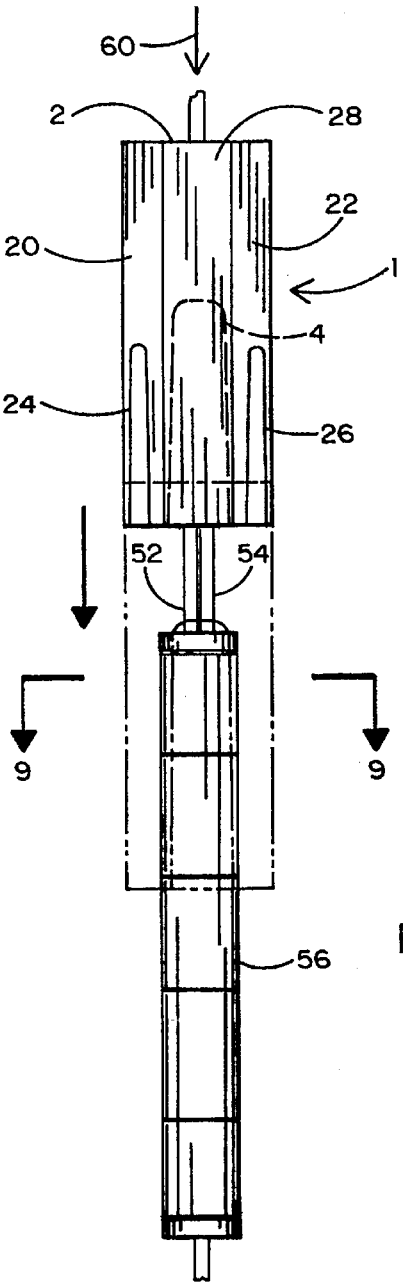
FIG. 8
FIG. 9
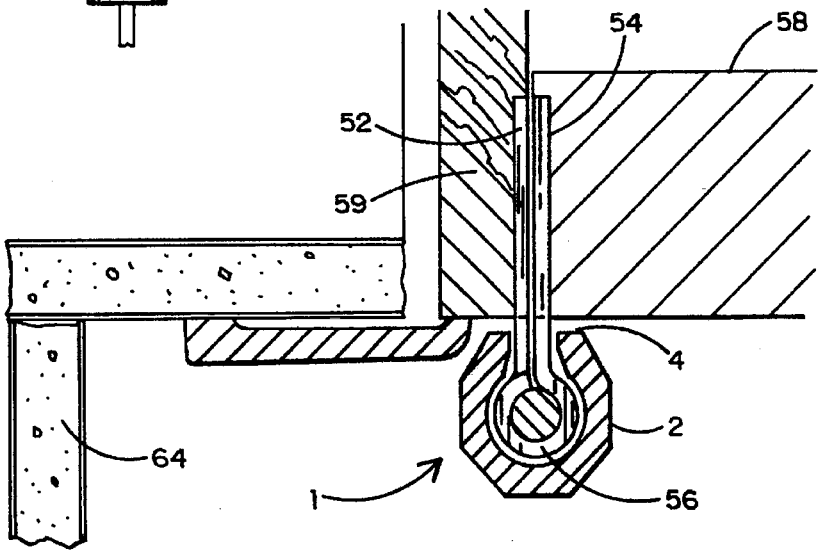

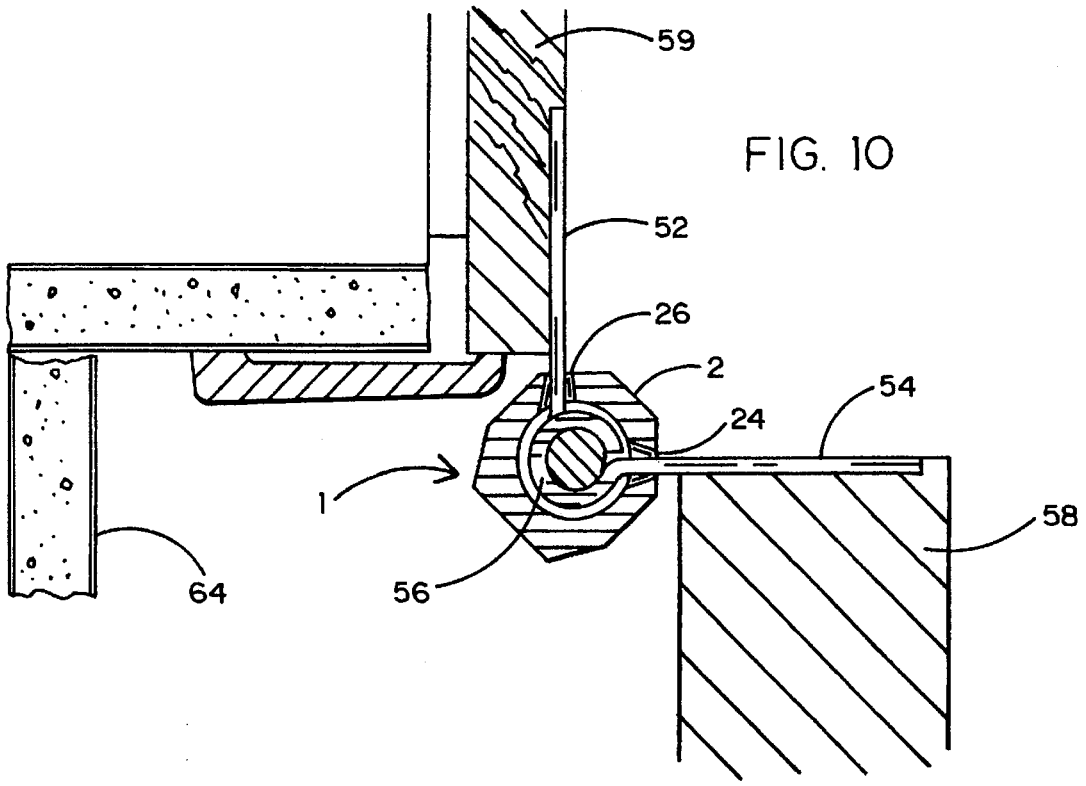
FIG. 10
FIG. 11
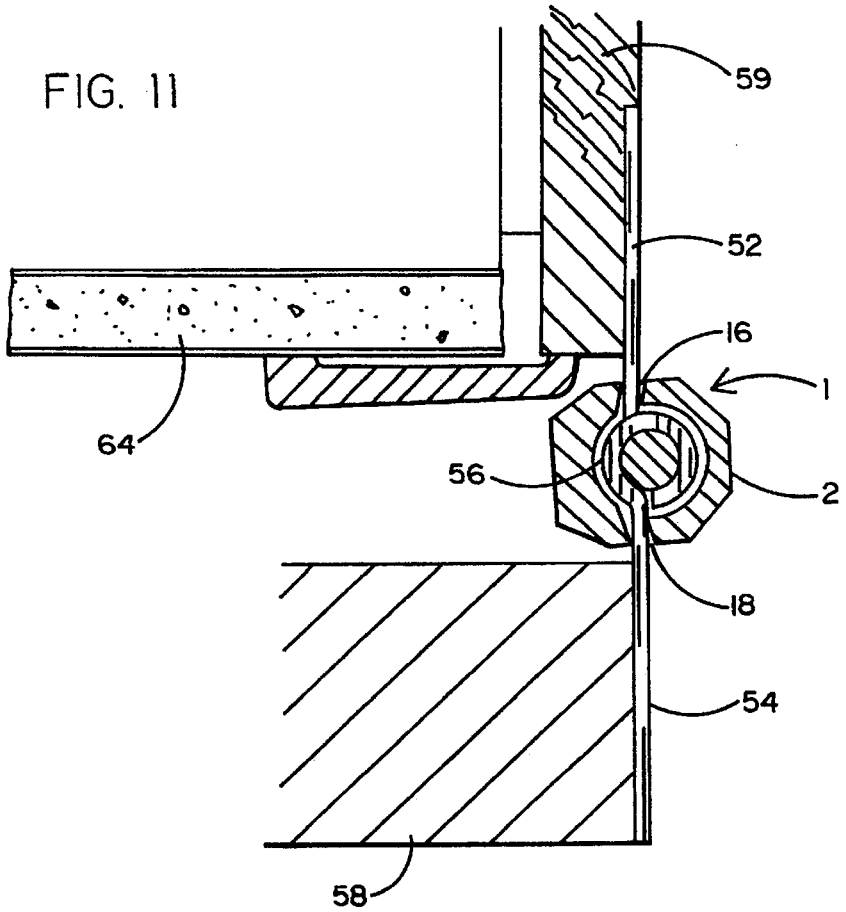

MULTI-POSITION DOOR HINGE LOCK

BACKGROUND OF THE INVENTION

1. Field of the Invention

This invention relates to a non-destructible, multi-position hinge lock to be coupled to the existing hinge assembly of a door so as to be capable of reliably retaining the door in either an opened or closed position relative to a doorway.

2. Background Art

Door stops have long been used to hold a door in an opened position relative to a doorway. In a majority of instances, the door stops are made from either rubber or wood or are wedged between the bottom of the door and the floor to inhibit movement of the door. However, these conventional door stops are known to crack, splinter, wear and generally disintegrate with prolonged use. Moreover, the tops of these door stops are sometimes sheared off by the force of the door to be held open, thereby causing such door stops to become unreliable, particularly when the door is subjected to a strong wind or a pulling force generated by a closing arm which operates to automatically bias the door towards a normally closed position across a doorway. As a consequence of the foregoing, a door stop as mentioned above is frequently discarded which leads to frustration on the part of the user. What is more, such door stops have little application for also retaining a door in a closed position so as to deny access to a room through a doorway that is closed by the door.

What is even more, the lack of a reliable door stop can prove to be very inconvenient. For example, when moving furniture into an apartment or boxes from a warehouse or when remodeling or constructing a room of a building, a dependable door stop is especially needed to hold open a door, particularly when only a single worker is available. Similarly, in certain police and fire fighting actions, it is often necessary to prevent a door from returning to the closed and locked position, whereby to deny law enforcement officers or fire officials continuous entry through the doorway. In each of these cases, a door stop which fails may leave an individual locked outside an area to which immediate access is required or faced with the undesirable and time consuming task of having to repeatedly open a door that continuously swings shut.

In an effort to replace the conventional door stops so as to overcome the problems inherent therewith and to be able to retain doors in both opened and closed positions to which they are moved, door stops have been introduced that are coupled to the existing hinge assembly of the door. More particularly, these door stops are located in surrounding engagement with the usual hinge pin whereby to prevent the hinge plates from rotating relative to one another. However, a single door stop may not be suitable for use in all positions of the door relative to a doorway. That is to say, different door stops may be required in order to retain a door in a closed position as well as an opened position.

Examples of stops that are coupled to the hinge assembly of a door or a shutter to control the movement of such door or shutter are available by referring to the following patents:

| | |
|---|---|
| IT 469,538 | March 4, 1952 |
| U.S. Pat. No. 104,294 | June 14, 1870 |
| U.S. Pat. No. 314,105 | March 17, 1885 |
| U.S. Pat. No. 485,613 | November 8, 1892 |
| U.S. Pat. No. 5,287,596 | February 22, 1994 |
| Des. 311,677 | October 30, 1990 |

SUMMARY OF THE INVENTION

A multi-position door hinge lock is disclosed including an elongated body having a hollow, cylindrical interior in which to accommodate the hinge pin of a conventional door hinge assembly. A plurality of eight flat, longitudinally extending faces are disposed side-by-side one another around the exterior of the body. A relatively wide channel is formed in a face at the front of the hinge lock. The channel runs downwardly from the top of the hinge lock to a length of slightly more than one-half of the length of the front face in which the channel is formed. A first pair of relatively narrow channels are formed in respective faces at opposite sides of the hinge lock. The first pair of channels run upwardly from the bottom of the hinge lock to a length of slightly less than one-half the length of the side faces in which the channels are formed. A second pair of channels, identical in dimension to the aforementioned first pair of channels, are formed in respective faces aligned immediately behind and adjacent the side faces. The second pair of channels run downwardly from the top of the hinge lock to a length of slightly less than one-half the length of the faces in which the second pair of channels are formed. The remaining faces of the hinge lock extend continuously and interruptedly from top to bottom so as to be devoid of any channels.

As an important aspect of the present invention, the first pair of channels in the side faces of the hinge lock are angled so as to intersect one another at a point within the cylindrical interior of the body of the hinge lock that is offset from the center of a circle taken laterally through the body. More particularly, the point at which the first pair of channels intersects one another is spaced from the center of the circle by a distance equal to one-half the radius of the circle. Similarly, the second pair of channels are also aligned to intersect one another at a point within the cylindrical interior of the body of the hinge lock that is offset from the center of another circle taken laterally through the body. The point at which the second pair of channels intersects one another is also spaced from the center of the other circle by a distance equal to one-half the radius of the circle.

In use, the door is retained in a closed position across a doorway of a room when the door hinge lock is turned upside down and the top is moved downwardly towards the hinge assembly of the door with the pair of hinge plates aligned face-to-face one another. The pair of hinge plates are both received within the relatively wide channel in the front face of the hinge lock, and the hinge pin is received at the cylindrical interior of the body of the hinge lock to prevent the hinge plates from rotating apart and the door from opening. To retain a door which has been moved to an opened position inwardly of a room at an angle of 90 degrees with the doorway, the hinge lock is again turned upside down and the top is moved downwardly towards the hinge assembly of the door with the pair of hinge plates now being correspondingly rotated to form an angle of 90 degrees. The hinge plates are received within the second pair of narrow channels, and the hinge pin is received at the cylindrical interior of the body of the hinge lock to prevent the hinge plates from rotating towards one another so as to hold the door open. To retain the door which has been moved to an opened position inwardly of the room, but at an angle of 180 degrees with the doorway, the bottom of the hinge lock is moved downwardly towards the hinge assembly of the door with the pair of hinge plates being correspondingly rotated to form an angle of 180 degrees. The hinge plates are received within the first pair of narrow channels in the side faces Of the hinge lock, and the hinge pin is received at the cylindrical interior of the body of the hinge lock to prevent the hinge plates from rotating towards one another so as to retain the door in the opened position.

BRIEF DESCRIPTION OF THE DRAWINGS

FIGS. 8 and 9 show the door hinge lock coupled to the existing hinge assembly of a door to retain the door in a closed position across the doorway of a room;

FIG. 10 shows the door hinge lock coupled to the existing hinge assembly to retain the door in an opened position after the door has been rotated inwardly of the room so as to make an angle of 90 degrees with the doorway; and FIG. 11 shows the door hinge lock coupled to the existing hinge assembly to retain the door in an opened position after the door has been rotated inwardly of the room so as to make an angle of 180 degrees with the doorway.

DETAILED DESCRIPTION

Figure 1:
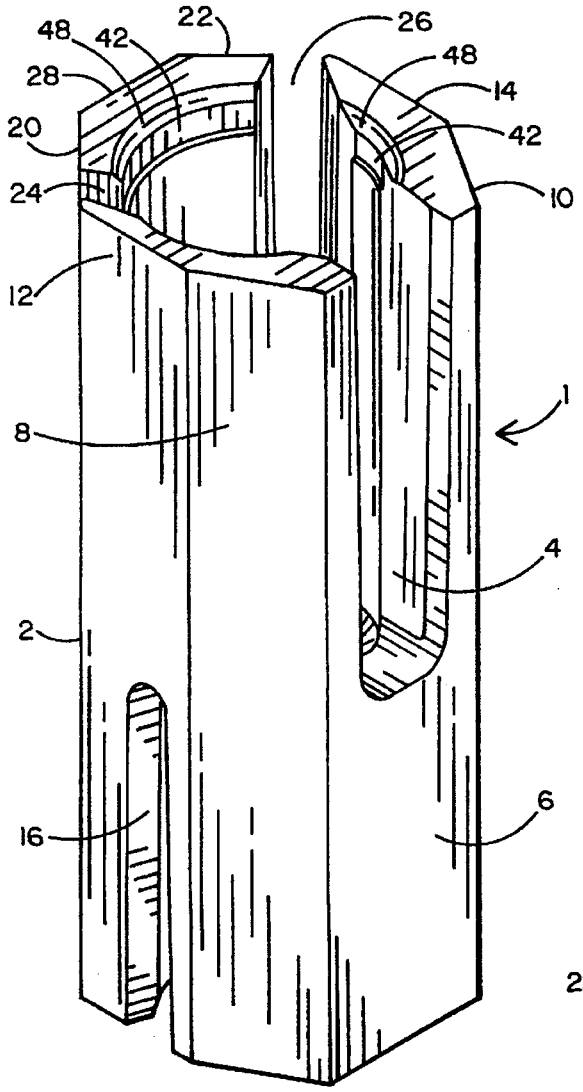
FIG. 1 is a perspective view showing the front and one side of the multi-position door hinge lock which forms the present invention.
Figure 2:
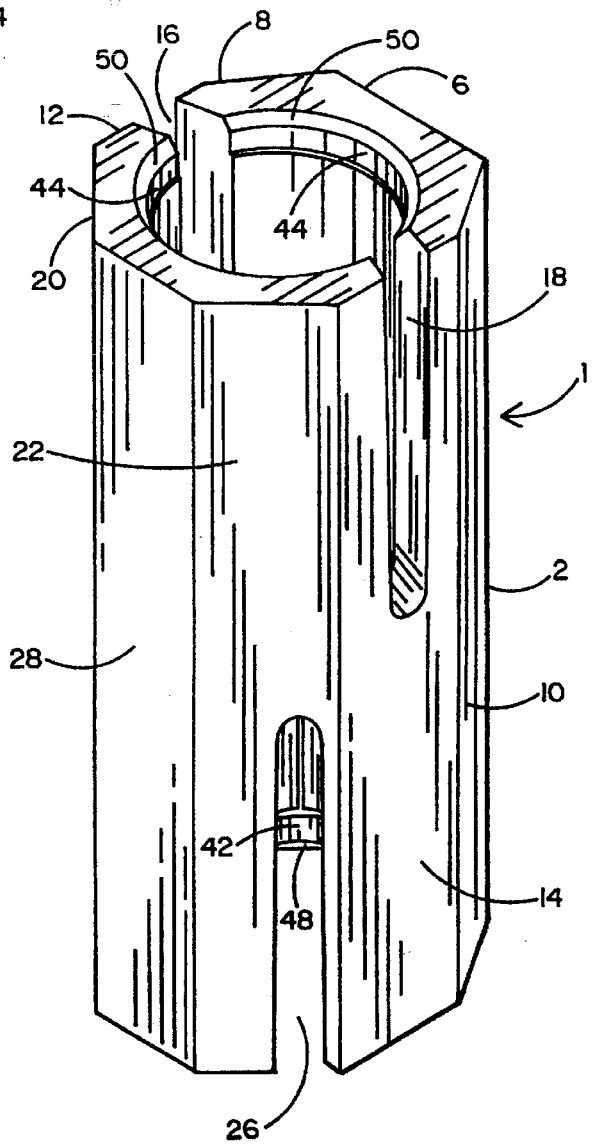
FIG. 2 is another perspective view showing the rear and opposite side of the multi-position door hinge lock of FIG. 1.

The multi-position hinge lock 1 which forms the present invention is best described while referring to the drawings. Referring initially and concurrently to FIGS. 1–7, the hinge lock 1 is shown including an elongated body 2 having a hollow, cylindrical interior. Hinge lock 1 is preferably manufactured from metal or rubber, although the material from which hinge lock 1 is manufactured is not to be considered a limitation of this invention. The hinge lock 1 has a plurality of eight flat, longitudinally extending faces which are disposed side-by-side one another around the exterior of the body 2 so as to enable the hinge lock 1 to advantageously perform different functions depending upon the position of the body 2 relative to the usual hinge assembly that is associated with a conventional door and the location of the door relative to a doorway as the door is rotated from opened to closed positions.

A relatively wide (e.g. 8 mm) channel 4 is formed through a first flat face 6 at the front of the body 2 of hinge lock 1. The channel 4 extends downwardly from the top of the hinge lock 1 to a length (e.g. 35 mm) of slightly more than one-half the length of flat face 6. The flat faces 8 and 10 lying immediately behind and adjacent the front face 6 are identical and extend continuously and uninterruptedly along the entire length of the hinge lock 1, i.e. the front face 6 is disposed between faces 8 and 10, and faces 8 and 10 are devoid of any channel formed therein.

Each of the flat faces 12 and 14 of hinge lock 1 that follows behind and lies adjacent respective ones of the aforementioned continuously extending faces 8 and 10 is identical and has a relatively narrow (4 mm) channel 16 and 18 formed therein. The faces 12 and 14 are arranged in parallel alignment with and spaced from one another at opposite sides of the hinge lock 1. The channels 16 and 18 in side faces 12 and 14 extend upwardly from the bottom of the hinge lock 1 to a length (e.g. 28 mm) of slightly less than one-half the length of the faces 12 and 14 in which channels 16 and 18 are formed. It may be appreciated that the reference herein to the top and bottom of the hinge lock 1 is for purpose of illustration, only, such that either end of the hinge lock may be considered the top and vice versa.

Each of the flat faces 20 and 22 of hinge lock 1 that follows behind and lies immediately adjacent respective ones of the side faces 12 and 14 is identical and has a relatively narrow channel 24 and 26 formed therein. The channels 24 and 26 in faces 20 and 24 are identical in shape and dimension to the narrow channels 16 and 18 formed in faces 12 and 14. Therefore, each of the channels 24 and 26 is approximately 4 mm wide and 28 mm long. However, the channels 24 and 26 extend downardly from the top of the hinge lock 1 to a length of slightly less than one-half the length of the faces 20 and 22 in which the channels 24 and 26 are formed.

Following immediately behind and disposed between the faces 20 and 22 at the rear of the hinge lock 1 is a flat face 28. The rear face 28 is located oppositely and in spaced parallel alignment with respect to the flat face 6 at the front of the hinge lock 1. However, unlike front face 6, the rear face 28 extends continuously and uninterruptedly along the entire length of the hinge lock 1 so as to be devoid of any channel formed therein.

To facilitate the use of the multi-position hinge lock 1 of this invention in order to perform different functions, the channels 16, 18, 24 and 26 are aligned (i.e. angled) according to a predetermined relationship. More particularly, and referring specifically to FIG. 3 of the drawings with regard to the top of hinge lock 1, a pair of axial reference lines 30 and 32 are shown being drawn through the respective channels 24 and 26 formed in the faces 20 and 22 of the body 2 of hinge lock 1. Reference lines 24 and 26 intersect one another at a point 34 within the hollow cylindrical interior of the body 2 of hinge lock 1 such that the distance $D_1$ between intersection 34 and the center $C_1$ of a circle taken laterally through body 2 is equal to one-half the radius of the circle.

By way of example only, the circle defined by the cylindrical interior of the body 2 of hinge lock 1 has a radius of 10 mm to accommodate a standard door hinge pin therewithin. Therefore, the distance $D_1$ between center $C_1$ and the intersection 34 of reference lines 30 and 32 is 5 mm. However, it is to be understood that these dimensions may change if the size of the hinge lock 1 herein disclosed is first changed to accommodate different door hinge pins.

Figure 3:
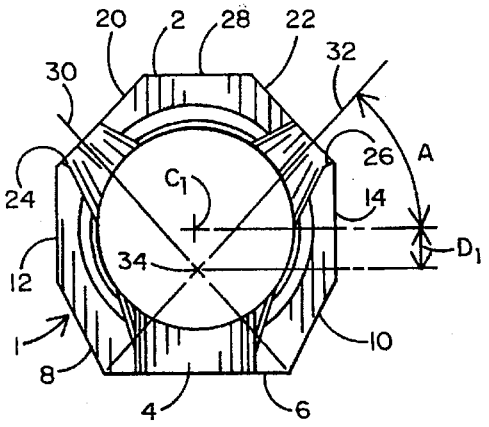
FIG. 3 is a top plan view of the multi-position door hinge lock of FIGS. 1 and 2.

What is more, an angle, designated A in FIG. 3, between one of the axial reference lines (e.g. 32) taken through one of the aforementioned channels (e.g. 26) and a radial reference line running perpendicularly through the center $C_1$ and the midpoint of a side face (e.g. 14) of hinge lock 1 is 45 degrees.

Figure 4:
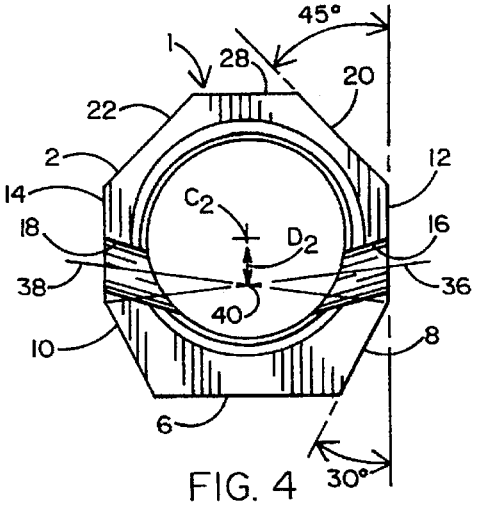
FIG. 4 is a bottom plan view of the door hinge lock.

Turning specifically now to FIG. 4 of the drawings with regard to the bottom of hinge lock 1, a pair of axial reference lines 36 and 38 are shown being drawn through the respective channels 16 and 18 formed in the side faces 12 and 14 of the body 2 of hinge lock 1. Reference lines 36 and 38 intersect one another at a point 40 within the hollow cylindrical interior of the body 2 of hinge lock 1 such that the distance $D_2$ (identical to the distance $D_1$ shown in and described when referring to FIG. 3) between the intersection 40 and the center $C_2$ of another circle taken laterally through body 2 is equal to one-half the radius of the circle (e.g. 5 mm).

As has been described above, the point 34 at which the axial reference lines 30 and 32 through channels 24 and 26 intersect one another (best shown in FIG. 3) as well as the point 40 at which the axial reference lines 36 and 38 through channels 16 and 18 intersect one another (best shown in FIG.

4) are offset relative to the centers (designated $C_1$ and $C_2$ in each of FIGS. 3 and 4) of the circles that are defined by the hollow cylindrical interior of the body 2 of hinge lock 1. This offset alignment of the points 34 and 40 of intersection relative to the center of the cylindrical interior of body 2 is considered to be significant inasmuch as the hinge lock 1 has been found to be better able to withstand potentially destructive mechanical forces being applied thereto when hinge lock 1 is coupled to a pair of door hinge plates in the manner that will be disclosed in greater detail hereinafter.

As an additional feature of the present invention, each of the top and bottom of the hinge lock 1 is provided with a short (e.g. approximately 2 to 3 mm), peripheral counterbore 42 and 44 extending around the cylindrical interior of the body 2. Counterbores 42 and 44 provide the advantage of adapting the hinge lock 1 to accommodate hinge pins that are surrounded by cylindrical knuckled couplers that are aligned end-to-end one another in a stepped configuration. That is, a step between adjacent knuckled couplers will be received within the counterbores 42 and 44 regardless of which end of the hinge lock is coupled to the hinge plates.

What is even more, and by way of further advantage, each of the top and bottom of the hinge lock 1 is also provided with a peripheral, radiused relief area 48 and 50 extending around the cylindrical interior of the body 2 above respective counterbores 42 and 44. Relief areas 48 and 50 provide the hinge lock 1 with the capability of avoiding contact with and possible interference from bends that are common to most door hinge plates so as to facilitate a reliable coupling of the hinge lock 1 to the hinge plates in surrounding engagement with a door hinge pin, as will now be disclosed.

Figure 5:
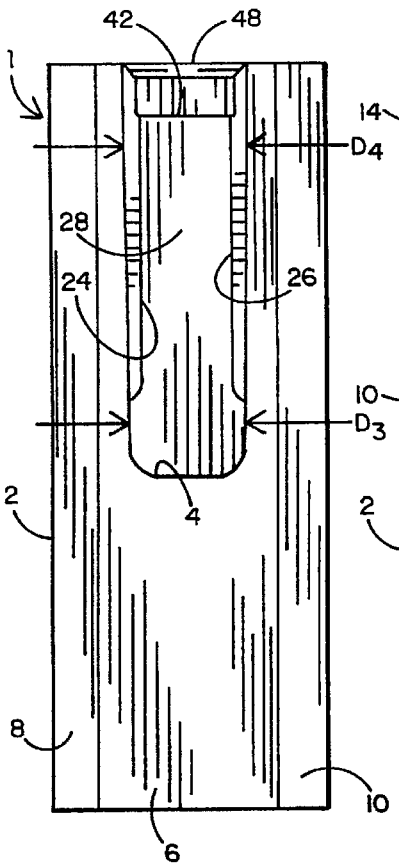
FIG. 5 is a front elevational view of the door hinge lock.
Figure 6:
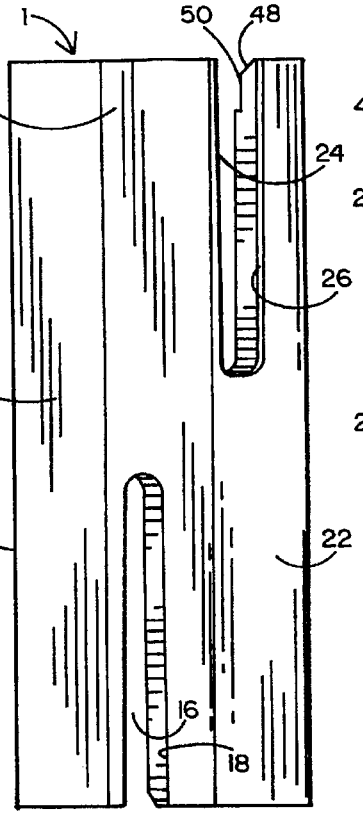
FIG. 6 is a side elevational view of the door hinge lock.
Figure 7:
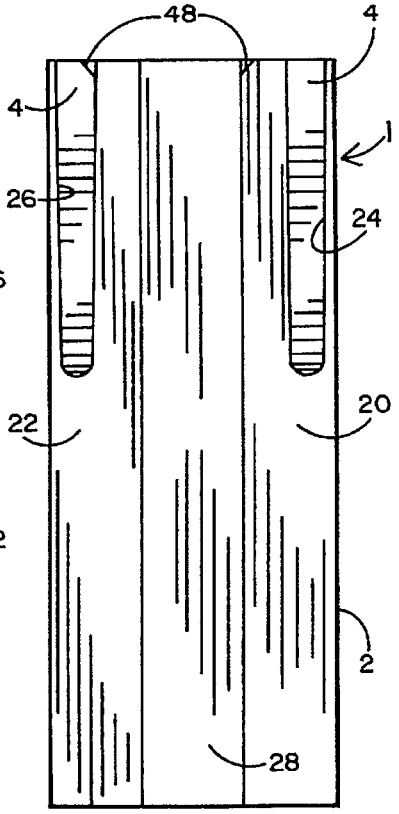
FIG. 7 is a rear elevational view of the door hinge lock.

To enable the hinge lock 1 to be more easily coupled to a pair of hinge plates, each of the channels 4, 16, 18, 24 and 26 is tapered so as to be slightly wider at the bottom or incoming end thereof. For example, as is best shown in FIG. 5, the dimension $D_4$ at the bottom of channel 4 is larger then the dimension $D_3$ at the top of channel 4. The tapered dimensions of the channels facilitates coupling should the hinge plates be covered with thick coats of paint.

The use of the multi-position hinge lock 1 is now described while referring to FIGS. 8–11 of the drawings. FIGS. 8 and 9 show the hinge lock 1 coupled to a pair of door hinge plates 52 and 54 so as to accommodate the usual door hinge pin 56. In the case of FIGS. 8 and 9, the hinge lock 1 is used to retain a door 58 in a closed position across a doorway, such that hinge lock 1 is coupled to hinge plates 52 and 54 from inside the room in which the user is located after the door is closed. The door hinge 1 is turned upside down and, as represented by the phantom lines of FIG. 8, the top of the door hinge is moved downwardly from above and towards the hinge pin 56 (in the direction of reference arrow 60) until the hinge pin 56 is received within the cylindrical interior of and surrounded by the body 2 of the door hinge 1 (best shown in FIG. 9).

With the door hinge properly installed, the relatively wide channel 4 formed in the front face 6 (best shown in FIGS. 1 and 5) receives both of the hinge plates 52 and 54 therein, which hinge plates 52 and 54 that are carried by the door jam 59 and the door 58 are rotated into face-to-face alignment with one another, such that the hinge lock 1 is seated upon and supported by the hinge plates 52 and 54 in surrounding engagement with the hinge pin 56. Accordingly, the hinge lock 1 reliably holds the door 58 in the closed position by preventing the opposing hinge plates 52 and 54 from rotating apart from one another. Therefore, the door 58 cannot be opened by one who is outside the room wishing to gain access to the room in which the user is located.

When the hinge lock 1 is installed to hold the door 58 closed, the channels 24 and 26 formed in respective faces 20 and 22 are not utilized. However, channels 24 and 26 enables the body 2 of hinge lock 1 to flex (i.e. expand) slightly in order to accommodate a wide hinge pin therewithin.

The aforementioned channels 24 and 26 formed in faces 20 and 22 are utilized to retain the door 58 in an opened position to allow continuous entrance into a room with which the door is associated. Referring now to FIG. 10, the door is positioned inwardly of the room so as to lie against a side wall 62 and form an angle of 90 degrees with the doorway, whereby the hinge lock 1 is once again coupled to the hinge plates 52 and 54 in surrounding engagement with the hinge pin 56. As in the case of FIGS. 8 and 9 where the door is to be held closed, the door hinge is turned upside down, and the top of the hinge lock is moved downwardly from above and in a direction towards the hinge pin 56. However, in this case, the hinge lock 1 may be installed from outside the room with which the door 58 is associated.

With the hinge plates 52 and 54 carried by the door jam 59 and the door 58 correspondingly rotated away from one another to form an angle of 90 degrees, the hinge lock 1 is moved downwardly towards the hinge pin 56 until hinge pin 56 is received within the cylindrical interior of surrounded by the body 2 and each of the hinge plates 52 and 54 is received by a respective one of the channels 24 and 26 in faces 20 and 22. Therefore, the hinge lock 1 is seated upon and supported by the hinge plates 52 and 54 in surrounding engagement with the hinge pin 56. Accordingly, the hinge lock 1 reliably holds the door 58 in the opened position shown in FIG. 10 by preventing the hinge plates 52 and 54 from rotating towards one another. In this regard, the door cannot be closed by the wind or a pulling motion applied thereto.

With the hinge lock 1 installed to hold the door 58 opened, as described immediately above, the channel 4 formed in the front face 6 is not utilized. However, channel 4 enables the body 2 of hinge lock 1 to expand slightly in order to accommodate a wide hinge pin therewithin.

FIG. 11 illustrates a use of the hinge lock 1 in situations where the door 58 is opened inwardly of a room with which the door is associated so as to lie against an interior wall 64 of the room and form an angle of 180 degrees with the doorway. Accordingly, the hinge plates 52 and 54 carried by the door jam 59 and the door 58 are now rotated relative to one another to form an angle of approximately 180 degrees. In this case, the bottom of the hinge lock 1 is moved downwardly from above and in a direction towards the hinge pin 56 until pin 56 is received within the cylindrical interior of and surrounded by the body 2 of hinge lock 1. In this same regard, each of the hinge plates 52 and 54 is received by a respective one of the channels 16 and 18 extending upwardly from the bottom of the faces 12 and 14. Therefore, the hinge lock 1 is once again seated upon and supported by the hinge plates 52 and 54 in surrounding engagement with the hinge pin 56. The hinge lock 1 reliably holds the door 58 in the opened position shown in FIG. 11 by preventing the hinge plates 52 and 54 from rotating towards one another. Thus, the door cannot be closed in response to a pulling force applied thereto.

By virtue of the presently disclosed multi-position door hinge lock 1, a door can be reliably retained in both opened and closed positions without requiring the use of different locks for a door that is opened and a door that is otherwise closed. The hinge lock 1 is essentially non-destructible, characterized by a low cost of manufacture, and of compact size to be easily and conveniently carried in a tool box or in the user's pocket.

It will be apparent that while a preferred embodiment of the invention has been shown and described, various modifications and changes may be made without departing from the true spirit and scope of the invention. For example, while the hinge lock of this invention has been described as having particular application for securing a door in an opened or a closed position relative to a doorway, it is to be understood that the presently disclosed hinge lock may also be coupled to the existing hinge assembly of a window shutter so as to retain such shutter in both opened and closed positions relative to a window with which the shutter is associated. In this case, the size of the hinge lock would be reduced proportionately to account for the smaller size of the shutter hinge assembly relative to a door hinge assembly.

Having thus set forth the preferred embodiment, what is claimed is:

1. A hinge lock to be coupled to a hinge assembly of a door that is rotatable between opened and closed positions relative to a doorway, the hinge assembly including a pair of hinge plates that are adapted to be rotated relative to one another when the door is rotated from said closed position to said opened position and a hinge pin located between the pair of hinge plates around which the hinge plates are rotated, said hinge lock comprising:

a body having a hollow interior in which to receive the hinge pin when said hinge lock is coupled to the hinge assembly;

a first longitudinal channel formed in said body in which to receive the pair of hinge plates when the door is rotated to a closed position across the doorway and the pair of hinge plates are correspondingly rotated into face-to-face alignment with one another; and second and third longitudinal channels formed in said body in which to receive respective ones of the pair of hinge plates when the door is rotated to an opened position relative to the doorway and the pair of hinge plates are correspondingly rotated to form an angle of 90 degrees.

2. The hinge lock recited in claim 1, wherein said first longitudinal channel is wider than each of said second and third longitudinal channels.

3. The hinge lock recited in claim 1, wherein the hollow interior of said body is cylindrical, such that a pair of axes extending in radial directions through respective ones of said second and third longitudinal channels intersect one another at a point within the hollow interior of said body, which point is offset from the center of a circle taken laterally through said cylindrical body and including said pair of axes.

4. The hinge lock recited in claim 3, wherein said point within the hollow interior of said body at which said pair of axes intersect one another is offset from the center of said circle by a distance equal to one-half the radius of said circle.

5. The hinge lock recited in claim 1, further comprising fourth and fifth longitudinal channels formed in said hollow body to receive respective ones of the pair of hinge plates when the door is rotated to an opened position relative to the doorway and the pair of hinge plates are correspondingly rotated to form an angle of 180 degrees.

6. The hinge lock recited in claim 5, wherein said first longitudinal channel is wider than each of said second, third, fourth and fifth longitudinal channels, said second and third longitudinal channels having the same dimensions as said fourth and fifth longitudinal channels.

7. The hinge lock recited in claim 5, wherein the hollow interior of said body is cylindrical, such that a pair of axes extending in radial directions through respective ones of said fourth and fifth longitudinal channels intersect one another at a point within the hollow interior of said body, which point is offset from the center of a circle taken laterally through said cylindrical body and including said pair of axes.

8. The hinge lock recited in claim 7, wherein said point within the hollow interior of said body at which said pair of axes intersect one another is offset from the center of said circle by a distance equal to one-half the radius of said circle.

9. The hinge lock recited in claim 5, wherein said body has a first end and an opposite end, each of said first, second and third longitudinal channels extending from said first end and running longitudinally along a portion of said body, and each of said fourth and fifth longitudinal channels extending from said opposite end and running longitudinally along another portion of said body.

10. The hinge lock recited in claim 9, further comprising a first counterbore formed at the first end of said body and extending around the hollow interior thereof and a second counter bore formed at the opposite end of said body and extending around the hollow interior thereof.

11. The hinge lock recited in claim 9, further comprising a first relief area formed at the first end of said body and extending around the hollow interior thereof and a second relief area formed at the opposite end of said body and extending around the hollow interior thereof.

12. The hinge lock recited in claim 5, wherein the exterior of said body includes a plurality of flat faces aligned side-by-side one another so as to extend around the periphery of said body, each of said first, second, third, fourth and fifth longitudinal channels formed in a respective one of said plurality of flat faces.

13. The hinge lock recited in claim 12, wherein said body has a front, a back and opposite sides, one of said plurality of flat faces being located at the front of said body and having said first longitudinal channel formed therein, a second and a third of said plurality of flat faces having said second and third longitudinal channels formed therein, and a fourth and a fifth of said plurality of flat faces being located at the opposite sides of said body and having said fourth and fifth longitudinal channels formed therein, said fourth and fifth flat faces at the opposite sides of said body being located between said first flat face at the front of said body and said second and third flat faces.

14. A hinge lock to be coupled to a hinge assembly of a swinging member that is rotatable between first, second and third positions, the hinge assembly including a pair of hinge plates that are adapted to be rotated relative to one another when the swinging member is rotated to each of the first, second and third positions and a hinge pin located between the pair of hinge plates around which the hinge plates are rotated, said hinge lock comprising:

a body having a hollow interior in which to receive the hinge pin when said hinge lock is coupled to the hinge assembly;

a first longitudinal channel formed in said body in which to receive the pair of hinge plates when the swinging member is rotated to the first position and the pair of hinge plates are correspondingly rotated into face-to-face alignment with one another;

second and third longitudinal channels formed in said body in which to receive respective ones of the pair of hinge plates when the swinging member is rotated to the second position and the pair of hinge plates are correspondingly rotated to form an angle of 90 degrees; and fourth and fifth longitudinal channels formed in said body in which to receive respective ones of the pair of hinge plates when the swinging member is rotated to the third position and the pair of hinge plates are correspondingly rotated to form an angle of 180 degrees.

* * * * *